United States Patent [19]

Klygis

[11] 4,243,162

[45] Jan. 6, 1981

[54] VESSEL STRUCTURE

[75] Inventor: Mindaugas J. Klygis, Barrington, Ill.

[73] Assignee: Illinois Tool Works Inc., Chicago, Ill.

[21] Appl. No.: 66,602

[22] Filed: Aug. 15, 1979

[51] Int. Cl.[3] ..... B65D 1/02

[52] U.S. Cl. ..... 222/530; 215/1 C

[58] Field of Search ..... 222/530, 534, 527, 528, 222/529, 215; 215/1 C

[56] References Cited

U.S. PATENT DOCUMENTS

| | | | |
|---|---|---|---|
| 187,561 | 2/1877 | Rightor | 222/530 |
| 1,236,273 | 8/1917 | Decker | 222/530 |
| 1,798,708 | 3/1931 | Smith | 222/530 |
| 2,031,672 | 2/1936 | Schaefer | 222/534 |
| 2,052,344 | 8/1936 | Edelmann | 222/530 X |
| 3,199,742 | 8/1965 | Hill | 222/529 X |
| 3,638,834 | 2/1972 | Goodrich | 222/530 X |

FOREIGN PATENT DOCUMENTS

| | | | |
|---|---|---|---|
| 1215061 | 11/1959 | France | 222/530 |

*Primary Examiner*—Donald F. Norton

*Attorney, Agent, or Firm*—Thomas W. Buckman

[57] ABSTRACT

There is disclosed an improved vessel for containing a quantity of fluid to be poured therefrom. The vessel includes a hollow body for containing a quantity of fluid and an elongated pouring spout communicating with the hollow body. The pouring spout is bendable between a pouring position to permit pouring of the fluid from the hollow body, and a storage position substantially along the hollow body to permit efficient storage of the vessel. The hollow body includes a retaining means for releaseably receiving and retaining the spout when the spout is bent to the storage position.

9 Claims, 8 Drawing Figures

VESSEL STRUCTURE

BACKGROUND OF THE INVENTION

The present invention is generally directed to a vessel structure for containing a quantity of fluid to be poured therefrom and more particularly to a vessel having an elongated spout for convenient pouring and which may be conveniently stored or transported.

Many fluids, in order to be properly utilized, must be poured through a rather long spout. For example, in adding fluid such as gasoline or gasoline additives to an automobile gas tank from a container, a rather long nozzle or spout is required to prevent spillage of the fluid and to enable complete emptying of the container when such is desired. The containers for such use therefore must either include or be adapted to receive an elongated spout.

Generally, containers adapted to receive such a spout are expensive, requiring a threaded aperture or other means for connecting the spout thereto. The aperture must additionally be provided with seal elements to prevent fluid leakage during pouring and evaporation of the contained fluid during storage or transport. Hence, such containers are generally inconvenient to use and, owing to their cost, are not economically disposable.

Other containers are also known which are formed from inexpensive plastic material having elongated spouts integrally formed thereon during a blow-molding formation process. Such containers are generally economically disposable. However, their rather long spouts project a considerable distance from the actual fluid containing portions of such containers rendering the same difficulty to conveniently store and transport.

It is therefore a general object of the present invention to provide a new and improved vessel for containing a quantity of fluid having an elongated pouring spout.

It is a more particular object of the present invention to provide such a vessel which may be conveniently stored or transported and which may also be manufactured at low cost, rendering the vessel economically disposable.

It is a still further object of the present invention to provide a vessel for containing a quantity of fluid which includes an elongated pouring spout to enable convenient pouring of the fluid therefrom and wherein the spout is displaceable to a storage position along the vessel to enable convenient storage or transportation of the vessel.

SUMMARY OF THE INVENTION

The invention therefore provides a vessel for containing a quantity of fluid comprising a hollow body for containing a quantity of fluid and an elongated pouring spout communicating with the hollow body. The pouring spout is bendable between a pouring position to permit pouring of the fluid from the hollow body, and a storage position substantially along the hollow body to permit efficient storage of the vessel. The vessel further includes retaining means carried by the hollow body for releasably retaining the spout in the storage position.

BRIEF DESCRIPTION OF THE DRAWING

The features of the present invention which are believed to be novel are set forth with particularity in the appended claims. The invention, together with further objects and advantages thereof, may best be understood by making reference to the following description taken in conjunction with the accompanying drawings, in the several figures of which like reference numerals identify identical elements, and wherein:

DESCRIPTION OF THE PREFERRED EMBODIMENT

Figure 1:
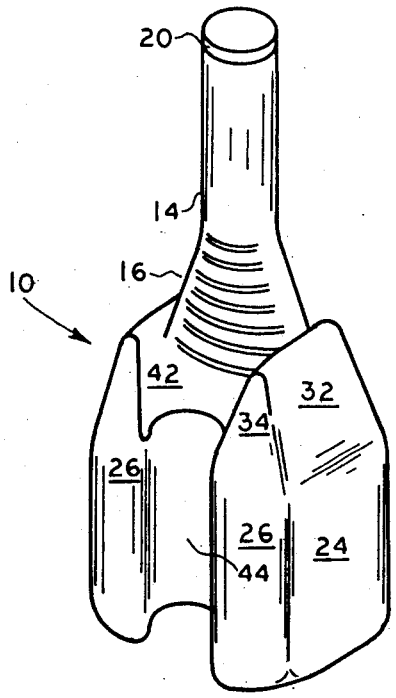
FIG. 1 is a perspective view of a vessel having an elongated spout embodying the present invention.

FIGS. 1 through 5 illustrate a first embodiment of the present invention. The vessel 10 thereshown generally includes a hollow body portion 12 and an elongated pouring spout 14. The elongated pouring spout 14 is joined to the hollow body portion 12 by a neck portion 16 and is in fluid communication with the hollow body portion 12. Preferably, the vessel 10 is formed from plastic material by a blow-molding process to thereby render the hollow body 12, the elongated spout 14, and neck 16 unitary in construction and in common fluid communication. The distal end 18 of the spout 14 may be suitably structured for receiving a cap 20 for sealing the vessel during the storage or transportation of the vessel.

Figure 2:
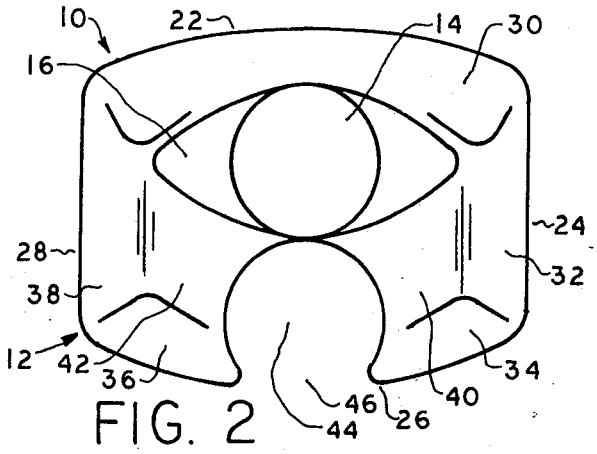
FIG. 2 is a top plan view of the vessel of FIG. 1.

As best seen in FIG. 2, the hollow body portion 12 includes a plurality of side walls 22, 24, 26, and 28, and inclined upper surfaces 30, 32, 34, 36, 38, 40 and 42. The neck portion 16 and spout 14 extend substantially vertically from the upper margins of the upper inclined surfaces. In this position of the elongated pouring spout 14, the vessel is adapted for convenient pouring of the fluid contained within the hollow body portion 12.

Figure 3:
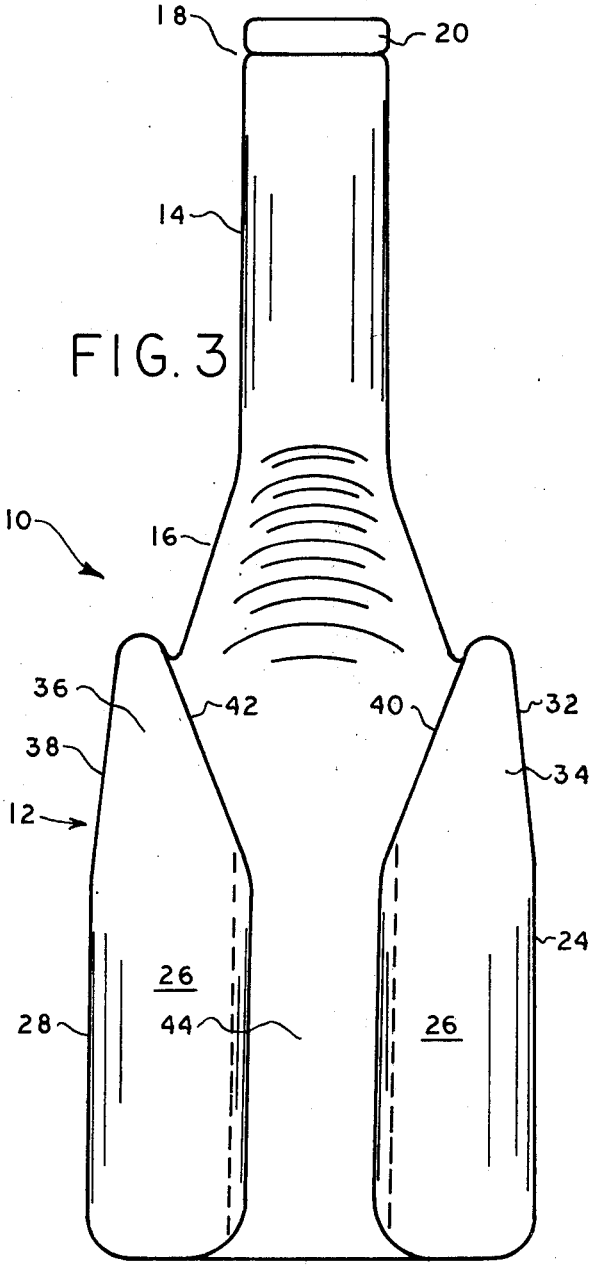
FIG. 3 is a front view of the vessel of FIG. 1.
Figure 4:
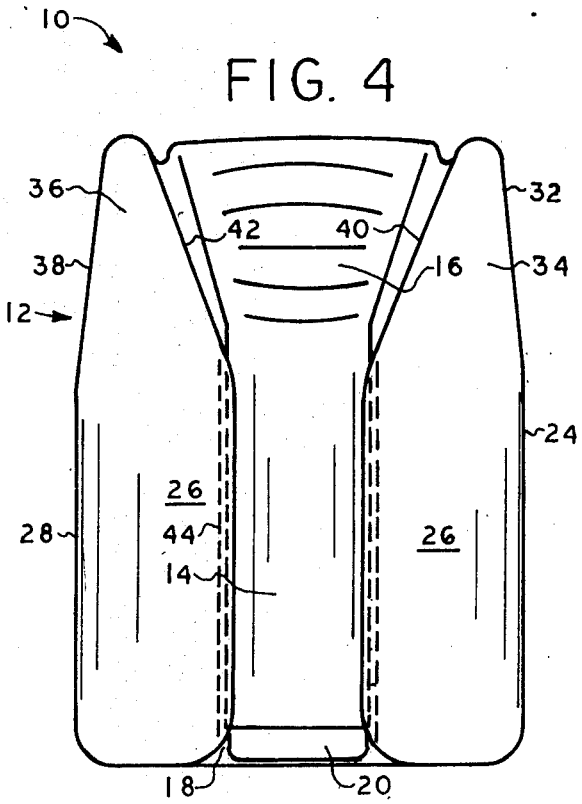
FIG. 4 is a front plan view of the vessel similar to FIG. 3 but illustrating the position of the elongated spout when disposed in a storage position.
Figure 5:
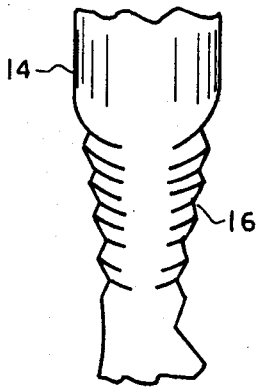
FIG. 5 is a partial side view of the vessel of FIG. 1 illustrating the configuration of the bendable spout of the vessel.

As may be best noted in FIGS. 1 and 5, the neck portion 16 is provided with a corrugated or bellow-like configuration to allow the pouring spout 14 to be bent from its substantially vertical position as illustrated in FIGS. 1 and 3 to a storage position substantially along the hollow body 12 as illustrated in FIG. 4. By virture of the fact that the vessel 10 is formed from a plastic material, and most suitably a resilient plastic material, the spout 14 will be easily bendable between its pouring position and its storage position.

For retaining the spout 14 in its storage position, the side wall 26 of the hollow body 12 includes a retaining means in the form of a recess or slot 44. As may best be noted in FIG. 2, the retaining means recess 44 is formed from the contour of the side wall 26. The inner dimension of the recess 44 substantially corresponds to the transverse dimension of the pouring spout 14. Furthermore, the recess 44 includes an opening 46 which is smaller in dimension than the maximum transverse dimension of the pouring spout 14. As a result, when the pouring spout 14 is bent from its pouring position to its storage position along the hollow body 12, the spout 14 is releasably received by the recess 44 through the opening 46. Because the opening 46 is smaller in dimension than the maximum transverse dimension of the spout 14, the spout will be retained within the retaining recess 44 for convenient storage or transportation of the vessel 10.

As best seen in FIGS. 3 and 4, the recess or slot 44 is elongated and receives substantially the entire length of the spout 14. Furthermore, the spout takes the form of a tubular or cylindrical extension from the neck portion 16. As a result, in substantial correspondance thereto, the recess or slot 44 is substantially C-shaped in cross-section.

In operation, when it is desired to pour the fluid from the vessel 10, the spout 14 is pulled free of the recess 44 and disposed in its substantially vertical position as shown in FIGS. 1 and 3. The cap 20 is then removed from the spout 14 and the fluid is poured from the hollow body 12. After the desired amount of fluid has been poured from the hollow body 12, the cap 20 is once again placed onto the spout 14 and the spout is bent downwardly to a substantially inverted position along the hollow body 12. As the spout 14 is bent toward its storage position as illustrated in FIG. 4, the resilient nature of the plastic from which the vessel is formed will permit the spout 14 and the recess opening 46 to be deformed to allow the spout 14 to pass through the opening 46 and into the recess or slot 44. Once the spout is within the recess or slot 44, the spout and side wall 26 will return to their original configurations due to the memory properties of the resilient plastic material. As a result, the opening 46 will once again be smaller in dimension than the maximum transverse dimension of the spout 14 to cause the spout to be retained within the recess 44 in its storage position.

Figure 8:
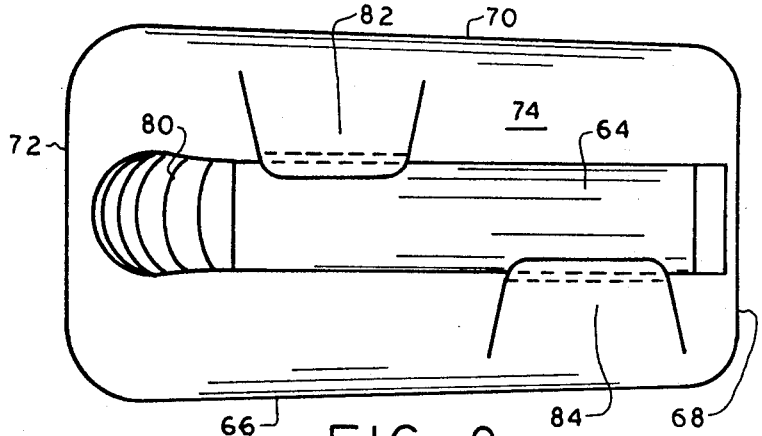
FIG. 8 is a top plan view of the vessel of FIG. 6 illustrating the elongated pouring spout in its storage position.
Figure 6:
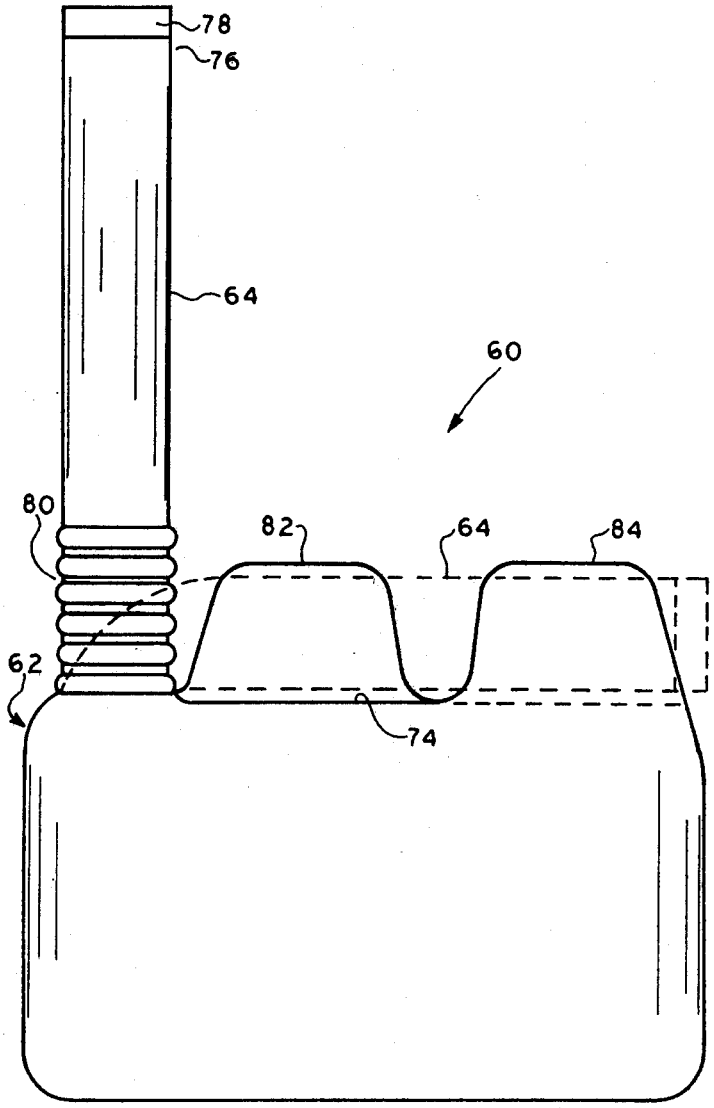
FIG. 6 is a front plan view of another vessel embodying the present invention showing the elongated spout in both a puring position and a storage position along the vessel.
Figure 7:
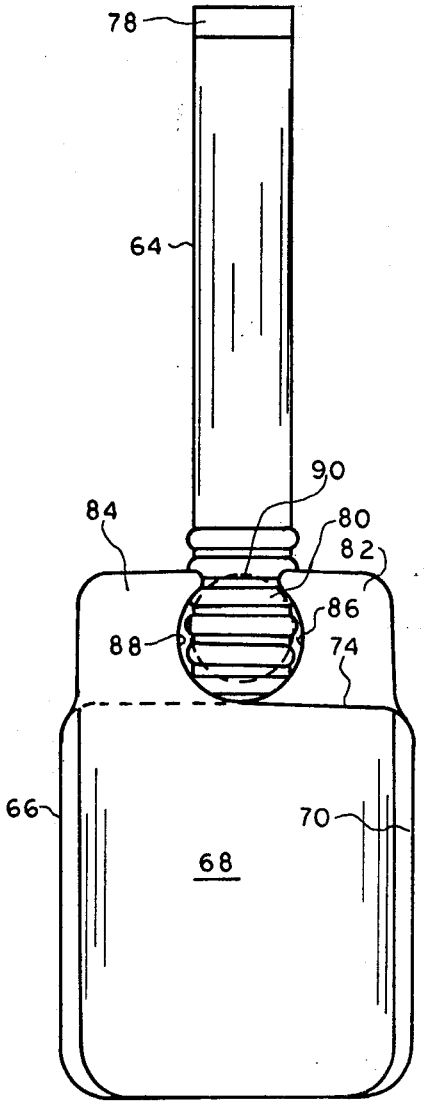
FIG. 7 is a side plan view of the vessel of FIG. 6.

Referring now to FIGS. 6 through 8, there is illustrated a second preferred embodiment of the present invention. The vessel 60 there shown comprises a generally rectangular hollow body 62 and an elongated cylindrical spout 64. As best seen in FIG. 8, the hollow body 62 includes side walls 66, 68, 70, and 72 and a top wall 74.

The elongated sprout 64 also includes a distal end 76 which is structured to receive a cap 78 for sealing the vessel 60. The elongated spout 64 as shown in its solid line position in FIG. 6 extends substantially vertically from the top wall 74 when the fluid contained within the vessel is to be poured therefrom. Like the vessel of the previous embodiment, the vessel 60 is also preferably formed from resilient plastic material and blow-molded so that the hollow body 62 and spout 64 are unitary in construction and in fluid communication.

The elongated spout 64 also includes a portion 80 which is corrugated or bellows-like in configuration to render the spout 64 bendable from its pouring position as shown in solid lines to its storage position as shown in dashed lines. When in the storage position, the elongated spout 64 extends along the top walls 74 of the hollow body 62. For retaining the elongated spout 64 in its storage position, the top wall 74 of the hollow body 62 includes an integral retaining means. More specifically, the top wall is contoured to define the retaining means and includes a pair of top wall extensions 82 and 84 which have arcuate or curved inner surface 86 and 88 respectively. The extensions 83 and 94 are laterally or longitudinally spaced from each other along the top wall 74 and as may be best noted in FIG. 7, co-act to form a slot dimensioned for receiving the spout 64. As in the previous embodiment, the slot defined by the inner surfaces 86 and 88 of the extension 82 and 84 respectively is dimensioned in substantial correspondance to the transverse dimension of the elongated spout 64. Furthermore, the extensions 82 and 84 co-act to define an opening 90 into the slot thus formed which is of lesser dimension than the maximum transverse dimension of the elongated spout 64. As a result, when the spout 64 is bent from its substantially vertical pouring position to its storage position along the top wall 74, the resilient nature of the plastic material from which the vessel is formed, will allow the spout 64 and the extensions 82 and 84 to be deformed to permit the spout 64 to pass through the opening 90 and into the slot formed by the extensions 82 and 84. Once the spout 64 is within the slot, the spout and extensions 82 and 84 will return to their original configurations due to the memory nature of the resilient plastic material such that the opening 90 is once again smaller in dimension than the maximum transverse dimension of the spout 64 to cause the spout to be retained within the slot and thus to be retained in its storage position.

From the foregoing, it can be appreciated that the present invention provides a new and improved vessel having an elongated spout to facilitate convenient pouring of fluid from the vessel. Not only is the vessel formed from blow-molded plastic material rendering the vessel economically disposable, but additionally, its spout is bendable from a pouring position extending from the hollow body of the vessel to a storage position along the hollow body to facilitate the convenient storage or transportation of the vessel. Furthermore, the vessel of the present invention includes an integral retaining means formed by the contour of a wall of the vessel for conveniently retaining the spout in its storage position. Lastly, and as can also be appreciated from the foregoing, when the spout is bent to its storage position, the dimension of the entire vessel is in substantial correspondance to the overall dimension of the hollow body of the vessel enabling the convenient storage and transportation of the vessel.

While particular embodiments of the present invention have been shown and described, modifications may be made, and it is therefore intended in the appended claim to cover all such changes and modifications which follow in the true spirit and scope of the invention.

The invention is claimed as follows:

1. A unitary vessel comprising a hollow body for containing a quantity of fluid; an elongated pouring spout integrally associated with said hollow body and communicating with said hollow body, said pouring spout being bendable between a pouring position to permit pouring of the fluid from the hollow body and a storage position substantially along said hollow body to permit efficient storage of said vessel; a flexible neck portion integrally formed connecting the hollow body and the pouring spout, said flexible neck portion being bellows-like to permit freely bending of the spout relative to the body, said bellows-like neck portion including undulations in planes extending generally perpendicular to the longitudinal axis of the spout when in a pouring position so that the spout may be freely and consecutively bent to and from a retained position, said hollow body, spout and neck portion formed from a resilient plastic material and retaining means carried by said hollow body for releasably retaining said spout in said storage position, said retaining means also being integrally formed of the same resilient plastic material and forming part of the outer periphery of the hollow body, at least one wall of the hollow body being contoured to thereby define said retaining means, the retaining means further defining a recessed portion in said at least one wall dimensioned for receiving said spout and including a throat portion with an opening defining a transverse dimension slightly smaller than the maximum transverse dimension of said spout, the maximum transverse dimension of said recessed portion being at least equal to the maximum transverse dimension of the spout thereby adapted to releasably receive the spout through said throat opening when the spout is bent about said neck portion for selectively retaining the spout within the recessed portion.

2. A vessel as defined in claim 1 wherein said spout comprises a cylindrical extension of said hollow body and wherein said recessed portion is substantially C-shaped in cross-section.

3. A vessel as defined in claim 1 wherein said recessed portion is elongated and adapted to receive substantially the entire length of said spout.

4. A vessel as defined in claim 1 wherein said hollow body includes at least one side wall and wherein said one side wall is contoured to define said retaining means.

5. A vessel as defined in claim 1 wherein said hollow body includes a top wall, wherein said bellows-like neck portion extends vertically from said top wall when in said pouring position, wherein said top wall includes said retaining means, and wherein said spout is arranged to be retained by said retaining means along said top wall when in said storage position.

6. A vessel as defined in claim 5 wherein said body top wall is contoured to define said retaining means.

7. A vessel as defined in claim 6 wherein said retaining means comprises a pair of top wall extensions having inner surfaces which coact to form a slot dimensioned for receiving said spout and an opening slightly smaller than the maximum transverse dimension of said spout for releasably receiving said spout through said opening and into said slot when said spout is bent to said storage position for retaining said spout within said slot.

8. A vessel as defined in claim 7 wherein said top wall extensions are laterally spaced from each other along said top wall.

9. A vessel as defined in claim 8 wherein said hollow body and said spout are integrally formed from resilient plastic material.

* * * * *